United States Patent [19]

Muzhzhavlev et al.

[11] 4,131,522

[45] Dec. 26, 1978

[54] PROCESS FOR ELECTROLYTICALLY PRODUCING MAGNESIUM AND CHLORINE FROM FUSED SALT BATH

[76] Inventors: Konstantin D. Muzhzhavlev, ulitsa Zheleznovodskaya, 48, kv. 30, Leningrad; Vladimir D. Yazev, ulitsa Jubileinaya, 64-56, Berezniki Permskoi oblasti; Vladimir I. Schegolev, ulitsa Korablestroitelei, 29, korpus 4, kv. 252; Andrei B. Ivanov, prospekt Smirnova, 59, kv. 151, both of Leningrad; Alexei V. Vasiliev, ulitsa Bogdana Khmelnitskogo, 66, kv. 57; Oleg N. Romanenko, ulitsa Sevastopolskaya, 6, kv. 46, both of Kalush Ivano-Frankovskoi oblasti; Sergei P. Kosarev, Nalichnaya ulitsa, 39-1, kv. 20, Leningrad; Vladimir G. Ovcharenko, ulitsa Bogdana Khmelnitskogo, 17, kv. 45, Kalush Ivano-Frankovskoi oblasti, all of U.S.S.R.

[21] Appl. No.: 837,857

[22] Filed: Sep. 29, 1977

[51] Int. Cl.[2] ..... C25B 1/00; C25C 3/04

[52] U.S. Cl. ..... 204/60; 204/70

[58] Field of Search ..... 204/60, 70

[56] References Cited

U.S. PATENT DOCUMENTS

| | | | |
|---|---|---|---|
| 2,055,359 | 9/1936 | Moschel | 204/70 |
| 2,974,093 | 3/1961 | Bauer et al. | 204/70 |

*Primary Examiner*—John H. Mack
*Assistant Examiner*—D. R. Valentine
*Attorney, Agent, or Firm*—J. Harold Nissen

[57] ABSTRACT

To produce magnesium and chlorine, a melt of anhydrous chlorides of magnesium, potassium and sodium is subjected to electrolysis. The molar ratio of potassium chloride to magnesium chloride in the initial mixture of chlorides ranges from 0.9 to 5.0 and the molar ratio of potassium chloride to sodium chloride in the melt ranges from 1.2 to 2.7 with the content of sodium chloride ranging from 19 to 38% by weight.

6 Claims, No Drawings

PROCESS FOR ELECTROLYTICALLY PRODUCING MAGNESIUM AND CHLORINE FROM FUSED SALT BATH

The present invention relates to electrochemical processes for producing magnesium and chlorine which are useful in metallurgy.

Magnesium, a light metal, is used as a component of light alloys employed in the manufacture of various structures as well as a material for electrodes for cathodic protection of metals against corrosion; chemical reducing agent, for example, in the production of titanium; as an additive imparting forgeability to iron.

Chlorine, a chemically active gas, is useful for various chemical applications, for example in the production of vinyl chloride, carbon tetrachloride, calcium hypochlorite. The salt accumulated in excess in the electrolytic bath is useful as a potassium fertilizer.

Known in the art are several commercially implemented electrolytic processes for producing magnesium and chlorine. These processes are distinguished therebetween mainly by the composition of the salt to be subjected to electrolysis and containing magnesium chloride.

In one of said prior art processes subjected to electrolysis is molten magnesium chloride resulting from reduction of titanium tetrachloride by metallic magnesium and containing a minor amount of impurities. The electrolysis products, i.e. magnesium and chlorine are employed mainly in the production of titanium.

In another process, subjected to electrolysis is a molten anhydrous salt containing predominantly magnesium chloride which salt is prepared in two stages from an aqueous solution of magnesium chloride. In the first stage the solution is subjected to a spray drying; in the second stage the resulting powder is melted, the melt is heated to a temperature within the range of from 800° to 900° C. and magnesia is then settled to give a molten anhydrous salt containing 70 to 80% by weight of magnesium chloride which salt is then fed to electrolysis. This process, however, has found no extensive implementation in industry due to substantial losses of magnesium chloride and large capital investments.

Most employed commercially is a process for producing magnesium and chlorine, wherein subjected to electrolysis is a molten anhydrous salt containing chlorides of magnesium potassium and sodium at molar ratios between $KCl:MgCl_2$ = = 0.9:1 to 5.0:1 preferably of from 1.05 to 1.25:1, and KCl:NaCl = 4.0:1 to 7.0:1.

This molten salt is produced in the following manner. First prepared is a solid salt consisting mainly of carnallite $MgCl_2.KCl.6H_2O$ and also containing sodium chloride and as a rule, an excessive amount of potassium chloride. Said solid salt can be prepared by recrystallization of naturally-occurring carnallite or by reacting potassium chloride with an aqueous solution of magnesium chloride. Thereafter, the solid salt is dehydrated to a water content of from 2 to 4% by weight which is effected by contacting the salt with flue gases; owing to the fact that substantially all magnesium chloride is combined in carnallite and its liability to hydrolysis is lowered, the solid salt can be dehydrated in a fluidized bed so as to provide good technological parameters. Content of magnesia in the dehydrated solid salt does not exceed 2% by weight. The dehydrated salt is melted and treated with chlorine.

The thus-prepared molten anhydrous salt is batchwise poured from ladles into an electrolytic cell with an anhydrous molten electrolyte containing 6 to 12% by weight of magnesium chloride, 82 to 75% by weight of potassium chloride and 8 to 15% by weight of sodium chloride. Through the electrolyte maintained at a temperature within the range of from 710° to 740° C. continuously passed is direct current so that a molten metal, i.e. magnesium is evolved at steel cathodes and gaseous chlorine is liberated at graphite anodes. Magnesium is lifted to the surface from the cathodes and accumulated in the electrolytic cell, wherefrom it is periodically discharged by means of a vacuum-ladle and delivered to refining and casting. The gaseous chlorine is continuously sucked from the cell and fed into compressors. Since only magnesium chloride is subjected to electrolysis, chlorides of potassium and sodium are accumulated in the electrolytic cell and the electrolyte level is gradually increased. To maintain the electrolyte level in the electrolytic cell below the maximum permitted, the accumulated in excess molten salt is periodically pumped out and fed into steel vessels, wherein the salt is crystallized and cooled. The salt cooled to a temperature below 400° C. is crushed and employed as a potassium fertilizer for the production of carnallite. To reduce losses of magnesium chloride, the salt accumulated in excess is pumped-out in several hours after pouring of the starting melt when, as a result of electrolytic decomposition, the content of magnesium chloride in the electrolyte becomes minimally permitted, i.e. decreased down to 6% by weight of $MgCl_2$.

The above-described prior art process for producing magnesium and chlorine, wherein chlorides of magnesium, potassium and sodium are fed at a molar ratio of $KCl:MgCl_2$ ranging from 0.9:1 to 5.0:1 into the electrolyte containing the same chlorides has certain essential disadvantages.

It does not make possible to conduct electrolysis at the electrolyte temperature below 710° C., since the melting point of the electrolyte with the above-mentioned amounts of chlorides of magnesium, potassium and sodium therein exceeds 700° C. As a result, at the electrolyte temperature below 710° C. at the bottom and inner walls of the electrolytic cell the salt is crystallized and this deposit is accumulated thus causing difficulties in the normal electrolytic process. The electrolyte circulation is impaired, metallic magnesium at the electrolyte surface is burning intensively; short circuits occur between the electrodes through the crust deposit; cleaning of the electrolytic cell bottom from the slime accumulated gradually as a result of deposition of solid particles of oxides and metals is also hindered.

If the electrolyte temperature is to be maintained at 720° C. and over, the crust is not growing at the walls and bottom of the electrolytic cell, though other serious disadvantages occur. Upon elevation of temperature, the current efficiency is lowered due to an increased rate of chlorination of magnesium and harmful impurities such as metallic iron and oxides thereof; said decrease in the current efficiency reaches 0.2% per 1° C. Accordingly, power consumption per unit mass of the resulting magnesium is increased and output of the electrolytic cell is decreased. Service life of electrodes: graphite anodes and steel cathodes is also reduced; in doing so, due to non-uniformity of wear of the electrodes, the distribution of electric current between parallel-connected electrochemical cells is upset, thus resulting in an increased specific power consumption and lowered electrolytic cell output.

Moreover, the presence, in the electrolyte, of chlorides of sodium and potassium in the above-mentioned amounts results in an additional increase in specific power consumption due to the fact that potassium chloride has an insufficient electric conductivity (of the order of 1.7 $Ohm^{-1} \cdot cm^{-1}$).

The content of magnesium chloride in the electrolyte equal to 6% by weight is minimal permitted for this prior art process, since at a lower content of magnesium chloride melting temperature of the electrolyte exceeds 730° C. As a consequence, to avoid the growth of crust, it is necessary to ensure temperature conditions of above 730° C. which might result in substantially impaired technological parameters. On the other hand, decreasing said minimal content of $MgCl_2$ below 6% by weight in the electrolyte is quite desirable, since this would result in reduced losses of magnesium chloride with the discharged salt accumulated in excess in the electrolytic bath.

It is an object of the present invention to overcome the above-mentioned disadvantages inherent in the prior art processes.

It is the principal object of the present invention to provide such a process for producing magnesium and chlorine which would make it possible to reduce power consumption per unit mass of the resulting magnesium.

It is another object of the present invention to provide such a process for producing magnesium and chlorine which would make it possible to extend the service life of the electrolytic cell.

It is a further object of the present invention to provide such a process for producing magnesium and chlorine which would make it possible to lower specific consumption of the starting materials.

The present invention is directed to the provision of such a process for producing magnesium and chlorine, wherein use could be made of an electrolyte with such proportions of the components which would ensure lesser specific consumption rates of power and starting materials and a prolonged service life of the electrolytic cell.

These objects are accomplished by that in the production of magnesium and chlorine from a mixture of anhydrous chlorides of magnesium, potassium and sodium, wherein the molar ratio of potassium chloride to magnesium chloride is from 0.9 to 5.0, by electrolysis of a melt of said anhydrous chlorides followed by discharging the resulting magnesium and chlorine, in accordance with the present invention subjected to electrolysis is a melt of said chlorides, wherein the molar ratio of potassium chloride to sodium chloride ranges from 1.2 to 2.7 and sodium chloride content within the range of from 19 to 38% by weight.

Since the melting point of the electrolyte in this case does not exceed 670° C., the electrolysis can be conducted at a temperature within the range of from 670 to 710° C. without the risk of crust formation at the bottom and inner walls of the electrolytic cell.

It is advisable that the electrolysis be conducted at a temperature within the range of from 670 to 690° C.

Consequently, the electrolyte temperature can be reduced by 30 to 50° C. as compared to the prior art process, thus increasing the current effiency by 5 to 8 abs.%. Despite the temperature decrease, resulting in a certain decrease in electrical conductivity of the electrolyte, its electrical conductivity is by 0.15–0.35 $Ohm^{-1} \cdot cm^{-1}$ greater than in the prior art process due to an increased content of sodium chloride. As a result, specific power consumption during electrolysis is by 1,000–1,500 kW·hr/ton of magnesium lower than in the prior art process. The service life of electrodes is also increased thus reducing their consumption rate and an average, in time, ohmic resistance of the electrolytic bath and contributing to a further decrease in specific power consumption. The service life of the upper cover and other structural members of the electrolytic bath is prolonged, and labour conditions for the personnel are improved.

Further objects and advantages of the present invention will now become more fully apparent from the following detailed description of the process for producing magnesium and chlorine and Examples illustrating this process.

Into an electrolytic bath, periodically or continuously, together or separately, simultaneously or successively, in a solid or molten state, there are introduced chlorides of magnesium, potassium and sodium at a molar ratio of $KCl:MgCl_2$ above 0.9, preferably of from 1.05:1 to 1.25:1, and KCl:NaCl of from 2.7:1 to 1.2:1. If the salt composition is variable in time, said molar ratios are determined over the time intervals above 7 days. Most preferable is the embodiment, wherein said chlorides are fed simultaneously in the form of a molten anhydrous salt mixture batchwise poured into the electrolytic cell from ladles. Said salt mixture is prepared by a conventional method, except that for the control of the KCl:NaCl ratio within the required limits, said salt mixture is added with a necessary amount of sodium chloride at any stage of the mixture preparation. It is advisable to add sodium chloride to a solid salt dehydrated to a water content therein of from 2 to 4% by weight, prior to melting or during it. In doing so, it is also possible to add simultaneously potassium chloride thus increasing the molar ratio of $KCl:MgCl_2$ to 2:1 and over, thus lowering the consumption rate of chlorine for treating, therewith, of the molten salt mixture to chlorinate magnesia and water; this, however, causes certain difficulties in transportation of molten salts in ladles taking into account increasing amount of such salts handled in an electrolysis shop. In this connection, to perform said batchwise filling of the electrolytic cell from ladles, it is advisable to make use of a molten salt mixture of the following composition, percent by weight: 48–38 of $MgCl_2$, 43–35 of KCl, 12–24 of NaCl, 0.2–0.5 of MgO, other impurities being contained in the amount of not more than 1% by weight.

The amount of said molten salt mixture poured into the electrolytic cell, is adjusted so that the electrolyte has the following composition: 2.5 to 14% by weight of $MgCl_2$, 76 to 52% by weight of KCl, and 19 to 37% by weight of NaCl, other impurities (mainly $CaCl_2$) in the amount of not more than 2% by weight.

Direct current is continuously passed through the electrolyte while maintaining its temperature within the range of from 670 to 690° C. The molten metal, i.e. magnesium (its melting point is 650° C.), is evolved at the steel cathodes, while gaseous chlorine — at graphitic anodes. The molten magnesium has a density which is by 40 to 50 $kg/m^3$ less than the electrolyte of the above-mentioned composition and temperature. Therefore, while being accumulated and aggregated at the cathodes' surface, magnesium drops float upwards and, combining, form compact layers of the liquid metal floating at the electrolyte surface. The liquid metal is periodically discharged by means of a vacuum ladle and delivered to refining and casting. Gaseous chlorine is continuously evacuated from the electrolytic cell and fed into compressors, wherefrom it is transported to liquefaction or to a local customer, in particular to the treatment of a molten salt mixture prior to its pouring into electrolytic cells for the production of magnesium and chlorine.

The time of the subsequent pouring of the molten salt mixture into the electrolytic cell is defined by the data of a chemical analysis of the electrolyte and its level in the bath. The molten salt accumulated in excess is pumped out of the electrolytic bath after several hours from the pouring of the molten salt mixture to the maximal permitted level of the electrolyte to bring it down to the minimal permissible level. The molten salt is pumped out by means of centrifugal pumps or vacuum ladles amd poured into steel vessels, wherein it is crystallized. The crystalline salt is crushed and employed as a potassium fertilizer or for the preparation of carnallite.

When the salt accumulated in excess in the electrolyte is employed as a potassium fertilizer, it is preferable to supply the potassium chloride into the electrolyte at a molar ratio approaching the upper limit of the ratio between KCl and NaCl i.e. equal to 2.7. If this salt is to be recycled to the preparation of carnallite, it is advisible that the molar ratio between KCl and NaCl be approaching its lower limit, i.e. be equal to 1.2.

In both cases, the molten chlorides accumulated in excess should be preferably discharged at the magnesium chloride content in the electrolyte within the range of from 2.5 to 4.5% by weight, thus ensuring minimally possible losses of magnesium chloride with said chlorides. This is most important in their use as a potassium fertilizer; however, it is also of importance upon recycling thereof to the preparation of carnallite due to doubled expenses for preparation of the resulting stock for electrolysis and inavoidable additional losses of magnesium chloride.

In compliance with the above-mentioned limits of the molar ratio KCl:NaCl will result either in the disadvantages inherent in the prior art process (wherein KCl:NaCl is above 2.7) or in difficulties associated with a high turnover of sodium chloride employed for adjustment of the electrolyte composition (where KCl:NaCl is below 1.2). It is preferable to maintain the ratio KCl:NaCl within the range of from 2.2 to 1.5.

Surpassing the advisable limits of the electrolyte temperature according to the present invention will result either in a lowered current efficiency (where T is above 690° C.) or in the formation of crust of the electrolyte and magnesium at the bottom and inner walls of the electrolytic cell (where T is below 670° C.).

Surpassing the advisable limits of the content of magnesium chloride in the molten salt discharged from the electrolytic cell results in either increased losses of magnesium chloride (if this content is above 4.5% by weight) or in a sharp decrease in the current efficiency (if this content is below 2.5% by weight).

EXAMPLE 1

An anhydrous molten mixture of the following composition (principal components, percent by weight): 43 ± 1 $MgCl_2$, 38 ± 1KCl, 18 ± 1 NaCl which corresponds to the average molar ratios of $KCl:MgCl_2$ = 1.13; KCl:NaCl = 1.65 at the temperature of 700 ± 10° C. is periodically poured into an electrolytic cell from ladles. Direct current is constantly passed through the electrolyte while maintaining its temperature at 680 ± 5° C. and its composition is as follows, percent by weight: 3 to 14 $MgCl_2$, 65–59 KCl, 31–28 NaCl. The resulting metal, i.e. magnesium, is periodically discharged from the electrolytic cell by means of a vacuum ladle and delivered to refining and casting. Gaseous chlorine compressed by a compressor is delivered mainly to the production of chemicals. Owing to the electrolyte temperature lowering by 30 to 40° C. as compared to the prior art process, it has become possible to increase the current efficiency by about 7 abs.%. Furthermore, specific power consumption in the electrolysis is reduced by 1,300 kWt·hr/ton of the magnesium obtained. The accumulated in excess molten salt is evacuated from the electrolytic cell once a day at 3.0 ± 0.2% by weight of $MgCl_2$ and delivered to the preparation of carnallite.

EXAMPLE 2

Solid anhydrous carnallite, solid sodium chloride and solid potassium chloride are charged separately into an electrolytic cell. Over 3 hours charged is only anhydrous carnallite, over the following 3 hours — only sodium chloride and potassium chloride; thereafter this charging cycle is repeated. Molar ratios of the amounts of chlorides supplied both in the form of carnallite and in free form into the electrolytic cell over the period of more than 7 days are $KCl:MgCl_2$ = 1.1, KCl:NaCl = 2.7. The electrolyte composition is as follows) basic components, percent by weight): 4.3–7.0 $MgCl_2$, 74–72 KCl, 21–20 NaCl. Direct current passed through the electrolyte is adjusted in such a manner that the temperature of the electrolyte be maintained at 685 ± 5° C. The resulting magnesium and chlorine are removed from the electrolyte. Owing to the decrease in the electrolyte temperature by about 30° C. as compared to the prior art process, it has become possible to increase the current efficiency by about 7 abs.%. Furthermore, specific power consumption in the electrolysis is reduced by 1,300 kWt·hr/ton of magnesium. The molten salt accumulated in excess is pumped out of the electrolytic cell one a day at the content of magnesium chloride in the electrolyte of 4.3 ± 0.2% by weight. After crystallization and crushing, the resulting salt is employed as a potassium fertilizer.

EXAMPLE 3

An anhydrous molten mixture of the following composition (basic components, percent by weight): 42 ± 1 $MgCl_2$, 35 ± 1KCl, 23 ± 1 NaCl which corresponds to average molar ratios of $KCl:MgCl_2$ = 1.05, KCl:NaCl = 1.2 at the temperature of 700 ± 10° C. is batchwise poured into the electrolytic cell. Direct current is constantly passed through the electrolyte to maintain the temperature thereof at 675 ± 5° C. The electrolyte has the following composition (principal components, percent by weight): 2.5–12 $MgCl_2$, 59–53 KCl, 38–34 NaCl. The resulting magnesium and chlorine are further delivered to subsequent processing. The molten salt accumulated in excess is pumped out of the electrolytic cell twice a day at the content of $MgCl_2$ of 2.7 ± 0.2% by weight, and recycled to the stage of carnallite preparation. Resulting from the procedure of this Example are the advantages similar to those described in the foregoing Examples 1 and 2.

EXAMPLE 4

An anhydrous molten salt of the following composition (principal components, percent by weight): 44 ± 1 $MgCl_2$, 43 ± 1 KCl, 12 ± 1 NaCl, which corresponds to average molar ratios of $KCl:MgCl_2$ = 1.25; KCl:NaCl = 2.7 at the temperature of 700 ± 10° C. is batchwise poured into an electrolytic cell. Direct current is constantly passed through the electrolyte to maintain its temperature at 685 ± 5° C. The electrolyte composition is the following (principal components, percent by weight): 4.3–12 $MgCl_2$, 74–68 KCl, 21–19 NaCl. The resulting magnesium and chlorine are delivered to a further treatment. The molten salt accumulated in excess is pumped out of the electrolytic cell once a day at the content of $MgCl_2$ of 4.5 ± 0.2% by weight. After crystallization and crushing the thus-produced salt is employed as a potassium fertilizer. This Example gives the same advantages as those described in Examples 1 and 2 hereinbefore.

EXAMPLE 5

An anhydrous molten salt of the following composition (principal components, percent by weight): 45 ± 1 KCl, 8 ± 1 NaCl, 46 ± 1 $MgCl_2$ at the temperature of 700 ± 10° C. is batchwise poured into an electrolytic cell, whereinto there is additionally charged solid sodium chloride. Molar ratios of chlorides supplied for the electrolysis in both molten and solid state over the period above 7 days are as follows: $KCl:MgCl_2$ = 1.25; KCl:NaCl = 1.2. Direct current passed through the electrolyte is adjusted so as to maintain the electrolyte temperature at 675 ± 5° C. The electrolyte has the following composition (principal components, percent by weight): 2.5–12 $MgCl_2$, 52–53 KCl, 38–34 NaCl. The resulting magnesium and chlorine are delivered to a further treatment. The molten salt accumulated in excess is pumped out of the electrolytic cell twice a day at the content of $MgCl_2$ of 2.7 ± 0.2% by weight and recycled to the preparation of carnallite.

For the procedure described in this Example, the same advantages are chracteristic as those mentioned in Examples 1 and 2 hereinbefore.

What is claimed is:

1. A process for producing magnesium and chlorine in an electrolytic cell from a mixture of anhydrous magnesium, potassium and sodium chlorides, wherein the molar ratio of potassium chloride to magnesium chloride ranges from 0.9 to 5.0, comprising the following steps:

preparing an electrolyte in the electrolytic cell, comprising magnesium, potassium and sodium chlorides, wherein the molar ratio of potassium chloride to sodium chloride ranges from 1.2 to 2.7 and the content of sodium chloride in the melt ranges from 19 to 38% by weight;

maintaining the electrolyte temperature within the range of from 670° to 690° C.;

passing direct current through the electrolyte so as to recover magnesium and chlorine;

removing magnesium regularly from the electrolyte surface and withdrawing chlorine continuously from above the electrolytic cell bath; and replenishing the electrolyte with a mixture of chlorides comprising, by weight, 38 to 48% $MgCl_2$, 35 to 43% KCl, 12 to 24% NaCl, and 0.2 to 0.5% MgO and impurities of not more than 1%, as magnesium and chlorine are removed from the electrolytic cell.

2. A process as claimed in claim 1, wherein the molar ratio of potassium chloride to magnesium chloride is within the range of from 1.05 to 1.25.

3. A process as claimed in claim 1, wherein the molar ratio of potassium chloride to sodium chloride is within the range of from 1.5 to 2.2.

4. A process as claimed in claim 1, wherein the mixture is a molten salt mixture consisting essentially of 38–48% of $MgCl_2$, 35–43% of KCl, 12–24% of NaCl, 0.2–0.5% of MgO and impurities of not more than 1%, all by weight.

5. A process as claimed in claim 1 wherein the molar ratio of potassium chloride to sodium chloride ranges from 1.6 to 2.7 and the content of sodium chloride in the melt ranges from 19 to 30% by weight.

6. A process for producing magnesium and chlorine comprising removing part of the electrolyte from the electrolytic cell when the content of magnesium chloride in the electrolyte drops to within the range of 2.5 to 4.5% by weight.

* * * * *